US010900156B2

(12) United States Patent
Grynaeus et al.

(10) Patent No.: US 10,900,156 B2
(45) **Date of Patent: *Jan. 26, 2021**

(54) VOLUME NONWOVEN FABRIC

(71) Applicant: Carl Freudenberg KG, Weinheim (DE)

(72) Inventors: Peter Grynaeus, Birkenau (DE); Gunter Scharfenberger, Frankenthal (DE); Thomas Sattler, Wald-Michelbach (DE)

(73) Assignee: CARL FREUDENBERG KG, Weinheim (DE)

( * ) Notice: Subject to any disclaimer, the term of this patent is extended or adjusted under 35 U.S.C. 154(b) by 403 days.

This patent is subject to a terminal disclaimer.

(21) Appl. No.: 15/118,099

(22) PCT Filed: Feb. 17, 2015

(86) PCT No.: PCT/EP2015/053265

§ 371 (c)(1),
(2) Date: Aug. 11, 2016

(87) PCT Pub. No.: WO2015/124548

PCT Pub. Date: Aug. 27, 2015

(65) Prior Publication Data

US 2016/0355958 A1 Dec. 8, 2016

(30) Foreign Application Priority Data

Feb. 18, 2014 (DE) ..... 10 2014 002 060

(51) Int. Cl.

| | |
|---|---|
| ***D04H 1/732*** | (2012.01) |
| ***D04H 1/02*** | (2006.01) |
| ***D04H 1/54*** | (2012.01) |
| ***D04H 1/70*** | (2012.01) |
| ***D04H 1/72*** | (2012.01) |
| ***D04H 1/42*** | (2012.01) |
| ***D04H 1/558*** | (2012.01) |
| ***D04H 1/00*** | (2006.01) |
| ***A47G 9/08*** | (2006.01) |
| ***A47G 9/10*** | (2006.01) |
| ***A47G 9/02*** | (2006.01) |
| ***D04H 1/4266*** | (2012.01) |
| ***D04H 1/435*** | (2012.01) |
| ***D04H 1/4382*** | (2012.01) |

(52) U.S. Cl.

CPC ..... *D04H 1/005* (2013.01); *A47G 9/02* (2013.01); *D04H 1/00* (2013.01); *D04H 1/02* (2013.01); *D04H 1/4266* (2013.01); *D04H 1/435* (2013.01); *D04H 1/4382* (2013.01); *D04H 1/54* (2013.01); *D04H 1/70* (2013.01)

(58) Field of Classification Search

USPC .... 264/15, 110, 117, 121–122; 428/85, 218, 428/220, 369; 442/327, 361, 415

See application file for complete search history.

(56) References Cited

U.S. PATENT DOCUMENTS

| | | | | |
|---|---|---|---|---|
| 4,167,604 | A | 9/1979 | Aldrich | |
| 4,413,030 | A * | 11/1983 | Tesch | D04H 1/4266 428/218 |
| 4,481,247 | A | 11/1984 | Tesch | |
| 4,618,531 | A * | 10/1986 | Marcus | D06M 15/507 264/117 |
| 5,891,568 | A | 4/1999 | Hartzog et al. | |
| 6,372,004 | B1 | 4/2002 | Schultink | |
| 7,244,497 | B2 * | 7/2007 | Hartmann | D01F 1/10 428/373 |
| 2002/0132545 | A1 | 9/2002 | Lenz | |
| 2005/0020171 | A1 * | 1/2005 | Yoshida | B01D 39/163 442/327 |
| 2007/0026228 | A1 | 2/2007 | Hartmann et al. | |
| 2009/0100565 | A1 | 4/2009 | Grynaeus et al. | |
| 2011/0311795 | A1 | 12/2011 | Bartl et al. | |

FOREIGN PATENT DOCUMENTS

| | | | |
|---|---|---|---|
| CN | 1056849 | A | 12/1991 |
| CN | 2832859 | Y | 11/2006 |
| CN | 102282016 | A | 12/2011 |
| DE | 8000301 | U1 | 7/1980 |
| DE | 3881230 | T2 | 10/1993 |
| DE | 102005030484 | B4 | 11/2007 |
| EP | 0203469 | A1 | 12/1986 |
| EP | 0906981 | A1 | 4/1999 |
| EP | 1188548 | A2 | 3/2002 |
| EP | 1772258 | A1 | 4/2007 |
| JP | 10266053 | A | 10/1998 |
| JP | 11200213 | A | 7/1999 |
| JP | 2013237967 | A | 11/2013 |
| RU | 2182195 | C2 | 5/2002 |
| RU | 2240856 | C2 | 11/2004 |
| WO | WO 9114035 | A2 | 9/1991 |
| WO | WO 2005044529 | A1 | 5/2005 |
| WO | WO 2011132825 | A1 | 10/2011 |

* cited by examiner

*Primary Examiner* — Lynda Salvatore

(74) *Attorney, Agent, or Firm* — Leydig, Voit & Mayer, Ltd.

(57) ABSTRACT

A nonwoven fabric has a volume-giving material, in particular fiber balls, down and/or fine feathers, and has a maximum tensile strength, measured according to DIN EN 29 073 at a mass per unit area of 50 g/m$^2$ in at least one direction, of at least 0.3 N/5 cm, in particular of 0.3 N/5 cm to 100 N/5 cm.

17 Claims, No Drawings

VOLUME NONWOVEN FABRIC

CROSS-REFERENCE TO RELATED APPLICATIONS

This application is a U.S. national stage application under 35 U.S.C. § 371 of International Application No. PCT/EP2015/053265, filed on Feb. 17, 2015, and claims benefit to German Patent Application No. DE 10 2014 002 060.6, filed on Feb. 18, 2014. The International Application was published in German on Aug. 27, 2015, as WO 2015/124548 A1 under PCT Article 21(2).

FIELD

The invention concerns a nonwoven fabric comprising a voluminous material, especially fiber balls, down and/or fine feathers. The invention moreover concerns the use of this nonwoven fabric as a filler material for textile materials, such as blankets, garments and/or upholstered furniture, as well as a method for production of the nonwoven fabric.

BACKGROUND

Diverse fillers are known for textile applications. For example, fine feathers, down and animal hairs such as wool have already long been used for the filling of blankets and garments. Filler materials made of down are very pleasant to use, since they combine a very good thermal insulation with low weight. However, the drawback to these materials is that they only possess a slight mutual cohesion.

An alternative to the use of these filler materials is fiber balls. Fiber balls contain fibers intertwined more or less spherically with each other, usually having the approximate shape of a sphere. For example, fiber spheres are described in EP 0 203 469 A, which can be used as filler or upholstering material. These fiber balls consist of spirally curved and intertwined polyester fibers with a length of around 10 to 60 mm and a diameter between 1 and 15 mm. The fiber spheres are elastic and thermal insulating. The drawback to the described fiber spheres is that, like down, feathers, animal hair and the like, they possess only slight mutual cohesion. Such fiber balls are therefore only poorly suited as filler material for textile materials in which the fiber spheres are supposed to lie loosely, since they can slip on account of their slight adhesion. In order to prevent a slippage in the textile material, they are often stitched.

Another alternative to the use of down and animal hair is the use of fiber nonwovens or nonwoven fabrics as filler material. The nonwoven fabrics are objects made from fibers of limited length (staple fibers), filaments (endless fibers) or cut yarns of any type and any origin, which are in some way combined into a fleece (fiber sheet) and joined together in some way.

The drawback to traditional fiber nonwovens or nonwoven fabrics is that they possess less fluffiness than voluminous filler materials such as down. Furthermore, the thickness of typical nonwoven fabrics gets increasingly thinner over a long period of use.

SUMMARY

An aspect of the invention provides a nonwoven fabric, comprising: a volume-giving material, wherein the nonwoven fabric has a maximum tensile strength, measured according to DIN EN 29 073, at a mass per unit area of 50 g/m$^2$, in at least one direction of at least 0.3 N/5.

DETAILED

A problem which an aspect of the invention means to solve is to provide a nonwoven fabric which combines a good thermal insulating ability with good softness, large bulkiness, high compressive elasticity, low weight, and good fitting to the object being wrapped. At the same time, the nonwoven fabric should have an adequate stability, for example, in order to be handled as roll goods. In particular, the nonwoven fabric should be able to be cut and rolled up. Furthermore, a method should be provided for the manufacture of this nonwoven fabric, as well as the use of this nonwoven fabric as filler material for textile materials such as blankets, garments and/or upholstered furniture.

These problems are solved by a nonwoven fabric comprising a volume-giving material, especially fiber balls, down and/or fine feathers, wherein the nonwoven fabric has a maximum tensile strength, measured according to DIN EN 29 073-3, at a mass per unit area of 50 g/m$^2$, in at least one direction of at least 0.3 N/5 cm, in particular 0.3 N/5 cm to 100 N/5 cm.

The term volume-giving material is understood in the traditional sense according to the invention. In particular, by a volume-giving material is meant a material with a mean density of 0.01 g/L to 500 g/L, preferably from 1 g/L to 300 g/L, especially from 1.5 g/L to 200 g/L. According to the invention, fiber balls are used preferably as the volume-giving material. However, other volume-giving materials can also be used, such as down, fine feathers, aerogels and/or foam parts.

In contrast with the known products which contain volume-giving materials, the nonwoven fabric according to the invention is distinguished by a good maximum tensile strength. For example, the tensile strength can be adjusted so that the nonwoven fabric can easily be produced, further processed, and used as roll goods. The nonwoven fabric can be cut and rolled up. Furthermore, it can be washed without loss of function.

Furthermore, the nonwoven fabric according to the invention is distinguished by good softness, large bulkiness, high compressive elasticity, good rebounding ability, low weight, high insulating capacity and good fitting to the object being wrapped.

Surprisingly, it has been discovered that a nonwoven fabric according to the invention can be obtained when a volume-giving nonwoven fabric raw material, particularly one comprising fiber balls, down, fine feathers and/or foam parts, is produced by using a carding method. Thus, it has been unexpectedly found that the carding of such a raw material, especially when using a carding machine having at least one pair of spiked rolls, makes possible an efficient opening, blending, and orienting of this material—without the material being disrupted in the process. This was surprising, because fiber balls, down and/or fine feathers for example used as raw material are extremely delicate, so that it was assumed that they would be disrupted by the carding, which would detract from the stability and function of the end product. The advantage of a pairwise arrangement of the spiked rolls is that the metal spikes can intermesh with each other. With the intermeshing of the metal spikes, a dynamic screen is produced, by which the nonwoven fabric raw materials can be singled out and distributed uniformly.

Furthermore, a processing with pairwise arranged spiked rolls in the case of fiber balls can result in a loosening of the fiber structure, without disrupting the ball shape as a whole. Thus, fibers can be pulled out from the balls so that they stick out from the surface, yet are still connected to them. This is advantageous because the fibers so pulled out improve the mutual interlocking of the individual balls and thereby increase the tensile strength of the nonwoven fabric. Furthermore, a matrix of individual fibers can be formed, in which the balls are embedded, thereby enhancing the softness of the nonwoven fabric.

However, it has also been found that the carding makes possible a very uniform distribution of the raw material on the laying belt and a very homogeneous nonwoven fabric can be obtained in which the volume-giving material is uniformly distributed. The homogeneous distribution of the volume-giving material is of especially great interest in regard to the thermal insulating ability and softness of the nonwoven fabric.

As already mentioned above, the nonwoven fabric according to the invention is distinguished by a surprisingly well adjustable stability. For many applications, it has proven to be advantageous for the nonwoven fabric to have a maximum tensile strength, measured according to DIN EN 29 073-3, at a mass per unit area of 50 g/m$^2$, in at least one direction of at least 0.3 N/5 cm, in particular 0.3 N/5 cm to 100 N/5 cm. Furthermore, the nonwoven fabric according to the invention advantageously has a good restoring force. Thus, the nonwoven fabric preferably has a recovery of more than 50, 60, 70, 80 and/or more than 90%, the recovery being measured in the following way:

1) Six samples are stacked together (10×10 cm)
2) The height is measured with an inch ruler
3) The samples are loaded by an iron plate (1300 g)
4) After one minute of loading, the height is measured with an inch ruler
5) The weight is removed
6) After 10 seconds, the height of the samples is measured with the inch ruler
7) After one minute, the height of the samples is measured with the inch ruler
8) The recovery is calculated by forming the ratio of the values from points 7 and 2.

Thanks to its high stability, the nonwoven fabric can be easily rolled up and further processed, for example, as roll goods.

Furthermore, the nonwoven fabric is distinguished by an excellent thermal insulating capacity in combination with good softness, high bulkiness, compressive elasticity, low weight, and a very good fitting to the object being wrapped.

If fiber balls are used as the volume-giving raw material of the nonwoven fabric, their structure and shape can vary in dependence on the materials being used and the desired properties of the nonwoven fabric. In particular, the term fiber balls should be understood to mean both spherical and approximately spherical shapes, such as irregular and/or deformed, e.g., flattened spherical shapes. It has been discovered that spherical and approximately spherical shapes show especially good properties in regard to fluffiness and thermal insulation.

Moreover, the fibers can be arranged in the aggregates essentially in a spherical shell, while relatively few fibers are arranged at the center of the fiber spheres. But it is also conceivable, for example, to have a uniform distribution of fibers inside the fiber balls and/or a fiber gradient.

It is likewise conceivable for the fiber balls contained in the nonwoven fabric according to the invention to contain spherically twisted and/or fluffy fibers. In order to ensure a good cohesion of the aggregate, it is advantageous for the fibers to be curly. The fibers in this case can be disorderly or also have a certain order.

According to one embodiment of the invention, the fibers are tangled in the interior of the individual fiber balls and spherically arranged in an outer layer of the fiber balls. In this embodiment, the outer layer is relatively small in relation to the diameter of the fiber balls. In this way, the softness of the fiber balls can be even further enhanced.

The nature of the fibers present in the fiber balls is basically noncritical, as long as they are suitable to forming fiber balls, for example, by a suitable surface structure and fiber length. The fibers of the fiber balls are preferably chosen from the group consisting of staple fibers, threads and/or yarns. By staple fibers as distinguished from filaments which have a theoretically unlimited length is meant fibers with a limited length, preferably 20 mm to 200 mm. The threads and/or yarns also preferably have a limited length, in particular, of 20 mm to 200 mm. The fibers can be present as monocomponent filaments and/or composite filaments. The titer of the fibers can likewise vary. Preferably, the mean titer of the fibers lies in the range of 0.1 to 10 dtex, preferably 0.5 to 7 dtex.

Essentially the fiber balls can consist of the most diverse fibers. Thus, the fiber balls can comprise and/or consist of natural fibers, such as wool fibers and/or synthetic fibers, such as fibers of polyacryl, polyacrylonitrile, preoxidated PAN, PPS, carbon, glass, polyvinyl alcohol, viscose, cellulose, cotton polyaramides, polyamidimide, polyamides, especially polyamide 6 and polyamide 6.6, PULP, preferably polyolefins and most especially preferably polyester, especially polyethylene terephthalate, polyethylene naphthalate and polybutylene terephthalate, and/or blends of the aforementioned. According to one preferred embodiment, fiber balls of wool fibers are used. Especially shape-stable and good insulator nonwoven fabrics can be obtained in this way. According to another preferred embodiment, fiber balls of polyester are used in order to achieve an especially good compatibility with the other customary components inside the nonwoven fabric or in a nonwoven fabric composite.

The portion of the fiber balls in the nonwoven fabric is preferably at least 20 wt. %, even more preferably 25 to 100 wt., especially 30 to 90 wt., each time relative to the total weight of the nonwoven fabric.

If down and/or fine feathers are used as the volume-giving material according to the invention, their portion in the nonwoven fabric comprises for example 0 to 90 wt. %, preferably 20 to 70% or at least 50 wt. %. The term down and/or fine feathers is understood in the traditional sense according to the invention. In particular, by down and/or fine feathers is meant feathers with short quill and very soft and long barbs arranged in ray form, essentially with no hooks.

According to one preferred embodiment of the invention, the nonwoven fabric contains a thermally sensitive material, which is used for example in fiber or powder form during the production of the nonwoven fabric. The use of binder fibers is preferred according to the invention. These can be components of the fiber balls or be present as other fiber components in the fiber sheet, or in the resulting nonwoven fabric. The binder fibers used can be the traditional ones used for this purpose. Binder fibers can be single fibers or also multicomponent fibers. Especially suited binder fibers according to the invention are fibers of the following groups:

fibers with a melting point which lies below the melting point of the volume-giving material being bound, preferably below 250° C., especially 70 to 230° C., most preferably 125 to 200° C. Suitable fibers are in particular thermoplastic polyesters and/or copolyesters, especially PBT, polyolefins, especially polypropylene, polyamides, polyvinyl alcohol, or also copolymers and their copolymers and mixtures adhesive fibers, such as unstretched polyester fibers.

Especially suitable binder fibers according to the invention are multicomponent fibers, preferably bicomponent fibers, especially core/shell fibers. Core/shell fibers contain at least two fiber materials with different softening and/or melting temperature. Core/shell fibers preferably consist of these two fiber materials. The component having the lower softening and/or melting temperature is found at the fiber surface (shell) and the component having the higher softening and/or melting temperature is found in the core.

With core/shell fibers, the binder function can be provided by the materials which are arranged on the surface of the fibers. The most diverse of materials can be used for the shell. Preferred materials for the shell are according to the invention PBT, PA, copolyamides or also copolyesters. For the core, likewise the most diverse of materials can be used. Preferred materials for the core are according to the invention PET, PEN, PO, PPS or aromatic PA and PES.

The advantage of having binder fibers present is that the volume-giving material in the nonwoven fabric is held together by the binder fibers, so that a textile sheath filled with the nonwoven fabric can be used, without the volume-giving material shifting significantly or cold bridges being formed by missing filler material.

The binder fibers can be contained for example in the fiber balls. Alternatively or additionally, they can be present as separate fiber components in the nonwoven fabric. Preferably, the binder fibers have a length of 0.5 mm to 100 mm, even more preferably 1 mm to 75 mm, and/or a titer of 0.5 to 10 dtex. According to an especially preferred embodiment of the invention, the binder fibers have a titer of 0.9 to 7 dtex, even more preferably 1.0 to 6.7 dtex, and especially 1.3 to 3.3 dtex.

The portion of binder fibers in the nonwoven fabric is adjusted in dependence on the nature and quantity of the other components of the nonwoven fabric and the desired stability of the nonwoven fabric. If the portion of binder fibers is too low, the stability of the nonwoven fabric is worsened. If the portion of binder fibers is too high, the nonwoven fabric becomes too firm on the whole, which detracts from its softness. Practical trials have revealed that a good compromise between stability and softness is obtained when the portion of binder fibers lies in the range of 5 to 50 wt. %, preferably 7 to 40 wt. % and especially preferably 10 to 35 wt. %. In this way, a nonwoven fabric can be obtained which is stable enough to be rolled and/or folded. This makes the handling and further processing of the nonwoven fabric easier. Moreover, such a nonwoven fabric is washable. For example, it is stable enough to withstand three household washings at 40° C. without disintegration.

The binder fibers can be joined to each other and/or to the other components of the nonwoven fabric by a thermal fusion. Especially suitable methods have proven to be warm calendering with heated, smooth or engraved rolls, drawing through a hot air tunnel oven, hot air double belt oven and/or drawing on a drum through a flow of hot air. The advantage in the use of a double belt hot air oven is that an especially effective activation of the binder fibers can occur while at the same time smoothing the surface, while at the same time preserving the volume.

Alternatively, the nonwoven fabric can also be consolidated by subjecting the optionally preconsolidated fiber sheet to fluid jets, preferably water jets, at least once on each side.

According to another embodiment of the invention, the nonwoven fabric contains additional fibers not present in the form of fiber balls, which modify the properties of the nonwoven fabric in a desired manner. Since these fibers are not present in the form of fiber balls, they can have the most diverse surface quality and in particular they can also be smooth fibers. As already mentioned above, binder fibers can be used as additional fibers. However, it is also conceivable to use nonbinder fibers. Thus, for example, silk fibers can be used as additional fibers, in order to provide the nonwoven fabric with a certain luster. It is likewise conceivable to use polyacryl, polyacrylonitrile, preoxidated PAN, PPS, carbon, glass, polyaramides, polymanidimide, melamine resin, phenol resin, polyvinyl alcohol, polyamides, especially polyamide 6 and polyamide 6.6, polyolefins, viscose, cellulose, and preferably polyester, especially polyethylene terephthalate, polyethylene naphthalate and polybutylene terephthalate, and/or blends of the above.

Advantageously, the portion of the additional fibers in the nonwoven fabric is 5 to 80 wt. %, especially 20 to 70 wt. %. Preferably the additional fibers have a length of 1 to 200 mm, preferably 5 mm to 100, and/or a titer of 0.5 to 20 dtex.

According to another preferred embodiment of the invention, the nonwoven fabric contains a phase change material. Phase change materials (PCM) are materials whose latent heat of fusion, heat of dissolution, or heat of absorption is much greater than the heat which they can store on account of their normal specific caloric capacity (without the phase change effect). The phase change material can be contained in the material composite in particle form and/or fibrous form and be joined to the other components of the nonwoven fabric for example by the binder fibers. The presence of the phase change material can support the insulating action of the nonwoven fabric.

The polymers used to produce the fibers of the nonwoven fabric can contain at least one additive, chosen from the group consisting of paint pigments, antistatics, antimicrobials such as copper, silver, gold, or hydrophilic or hydrophobic treatment additives in a quantity of 150 ppm to 10 wt. %. The use of the mentioned additives in the polymers employed makes it possible to achieve customer-specific requirements.

The nonwoven fabric according to the invention can also contain additional layers. It is conceivable for the additional layers to be formed as reinforcing layers, for example, in the form of a scrim, and/or for them to comprise reinforcing filaments, nonwoven fabrics, woven fabrics, knitted fabrics and/or laid webs. Preferred materials for the forming of the additional layers are plastics, for example polyesters, and/or metals. The additional layers can be arranged advantageously on the surface of the nonwoven fabric.

The thickness of the nonwoven fabric is preferably chosen in dependence on the desired insulating effect and the materials used. Usually good results are achieved with thickness, measured according to the test procedure of EN 29073-T2, in the range of 2 mm to 100 mm.

The mass per unit area of the nonwoven fabric according to the invention is adjusted as a function of the desired purpose of application. Masses per unit area, measured according to DIN EN 29 073, in the range of 15 to 1500 $g/m^2$, preferably 20 to 1200 $g/m^2$ and especially 30 to 1000 $g/m^2$, have proven to be advisable for many applications.

Furthermore, the nonwoven fabric after consolidation can be subjected to a binding or refinement of chemical nature, such as an antipiling treatment, a hydrophobic or hydrophilic treatment, an antistatic treatment, a treatment to improve the fire resistance and/or to change the tactile properties or the luster, a treatment of mechanical kind such as roughening, sanforization, sandpapering, or a treatment in the tumbler and/or a treatment to change the appearance such as coloring or imprinting.

The nonwoven fabric according to the invention is excellently suitable for the production of the most diverse textile products, especially products which are meant to be thermophysiologically comfortable and also lightweight. Thus, another subject matter of the present invention is the use of the nonwoven fabric as shaping material, especially upholstering and/or filler material in garments, chairs and sofas, bedspreads, mattresses, as filter and/or suction mats, as spacers, foam replacement, wound dressings, fire protection material.

The invention moreover concerns the production of a nonwoven fabric as described above with a carding process.

It has been discovered that the nonwoven fabric according to the invention can be produced in especially efficient manner when the opening and distributing of the nonwoven fabric material is done by means of spiked rolls and/or spiked belts. In this way, a very uniform laying of the raw material of the nonwoven fabric can occur, for example on a laying belt, and a very homogeneous nonwoven fabric can be obtained, in which the volume-giving fiber material is very homogeneously and uniformly distributed. This was surprising, since it was to be presumed that, for example, the delicate fiber balls or down would be disrupted by the treatment with spiked rolls and/or spiked belts.

Practical trials have revealed that especially good results are obtained with the method according to the invention when it involves one or more of the following steps. The raw material, comprising volume-giving materials and optionally other components, is made as uniform as possible with at least one carding machine, comprising at least one pair of spiked rolls, in which the fiber raw materials are opened and blended with one another. After this, the fiber laying to form a nonwoven can be done in traditional manner, such as on a screen belt, a screen drum, and/or a transport belt. The nonwoven so formed can then be consolidated in traditional manner. Thermal consolidation, for example with a belt oven, has proven to be especially suitable according to the invention, since in this way an unwanted compacting of the nonwoven fabric can be avoided, such as would occur with a water jet consolidation, for example. The use of a double belt hot air oven has proven to be especially suitable. The advantage for the use of such a hot air oven is that an especially effective activation of the binder fibers can be achieved, while at the same time smoothing the surface and preserving the volume.

According to a preferred embodiment of the invention, the fibers and fiber balls are treated in a nonwoven shaping unit with at least two spiked rolls, in order to achieve a good opening and blending of the fibers and fiber balls. According to one advantageous embodiment of the invention, the spiked rolls are arranged in rows. Thus, the spiked rolls advantageously are arranged in at least one row. The advantage to arranging the spiked rolls in at least one row is that the metal spikes of neighboring spiked rolls can mesh with each other. Thus, each roll can at the same time form a pair with its neighboring roll, which can act as a dynamic screen. The rows can also be present in pairs (double rows), in order to achieve an especially good opening and blending of the fibers and fiber balls. Thus, the spiked rolls are advantageously arranged in at least one double row. It is likewise conceivable to put at least some of the fiber material through the same spiked rolls several times, by means of a return system. For example, an endless circulating belt can be used for the return. This is advantageously arranged between two rows of spiked rolls. Moreover, the endless belt can also be taken through several double rows of spiked rolls arranged one behind another or one above another.

According to an especially preferred embodiment of the invention, the method involves an aerodynamic nonwoven formation process, i.e., the nonwoven is formed preferably with the aid of air. Methods based on the airlaid or airlay process have proved to be especially suitable. The basic notion of this process is the delivery of the fiber material to an air flow, which enables a mechanical distribution of the fibers in the machine's lengthwise and/or transverse direction and finally a homogeneous fiber laying on a transport belt with suction underneath.

Air can be used here in the most diverse of process steps. According to an especially preferred embodiment of the invention, the entire transport of the fiber material occurs aerodynamically during the formation of the nonwoven, for example by means of an installed air system. But it is also conceivable that only special process steps, such as the removal of the fibers from the spiked rolls, are supported by additional air.

Practical trials have revealed that one or more of the following steps are performed preferably when carrying out the method based on the airlaid and/or airlay process:

Advisedly the processes of preparation or breaking up of the raw materials of the nonwoven fabric come directly before the process of formation of the nonwoven fabric. The blending with nonfibrous materials, such as down and/or foam parts, preferably occurs immediately during the distributing of the fiber material in the nonwoven formation system.

With the help of air as transport medium, the material can be transported via a feeding and distributing system to the nonwoven formation unit, where a targeted opening, swirling, and simultaneous homogeneous blending and distributing of the individual components of the raw material of the nonwoven takes place. For easy control of the feeding of material, the feeding of each material component advantageously occurs separately.

After this, the raw material of the nonwoven fabric is preferably treated with at least two spiked rolls, by means of which a preparation or breaking up of the fiber material is carried out. Especially good results are achieved when the raw material of the nonwoven fabric is taken through a series of rotating shafts studded with metal spikes as spiked rolls. The intermeshing of the metal spikes produces a dynamic screen, enabling large throughput volumes.

Advantageously, the shaping of the nonwoven fabric occurs on a screen belt with suction underneath. A tangled nonwoven structure with no definite fiber orientation can be produced on the screen belt, whose density stands in relation to the intensity of the bottom suction. By arranging a plurality of nonwoven shaping units in a line, a buildup of layers can be accomplished.

The advantage of the aerodynamic nonwoven formation is that the fibers and the other components optionally present in the nonwoven fabric raw material can be arranged in a tangled layer, making possible very high isotropy of properties. Besides structure-related aspects, this embodiment offers economic benefits which come from the volume of investment and the operating costs for the production facilities.

According to one embodiment of the invention, the formation of the nonwoven occurs in a plurality of consecutively arranged nonwoven shaping units. Thus, it is conceivable to take a laying belt, such as a screen belt with bottom suction, through a plurality of nonwoven shaping units in succession, in each of which the laying of a layer of nonwoven takes place. In this way, a multilayered nonwoven can be created.

The consolidation of the nonwoven fabric can be done in traditional manner, such as chemically by spraying with binder agent, thermally by melting of the previously added adhesive fibers or adhesive powder, and/or mechanically, such as by needling and/or water jet treatment.

Practical trials have revealed that the nonwoven formation with a device for production of a fiber nonwoven fabric for example as described in publication WO 2005/044529 can be done with good results.

The nonwoven fabric according to the invention is excellently suited as shaping and/or filler material for the production of textile materials, such as blankets, garments and/or upholstered furniture, bedspreads, mattresses, as filter and/or suction mats, spacers, foam replacement, wound dressings and/or fire protection material.

The invention shall be described more closely below with the aid of several examples.

Example 1

150 g/m$^2$ of 50 wt. % fiber balls of 7 dtex/32 mm PES siliconized (Advansa 732), 30 wt. % fiber balls of CoPES binder fiber and 55 wt. % down and/or fine feathers and feathers from the Minardi company are placed on a support belt in an air-laid plant of the Form Fiber company, having spiked rolls for the opening of the fiber raw material, and consolidated in a double belt oven with a belt spacing of 12 mm at 155° C. The dwell time was 36 seconds. A rollable web material was obtained.

Example 2

120 g/m$^2$ of 35 wt. % fiber balls of 7 dtex/32 mm PES siliconized (Advansa 732), treated with 40% mPCM 28° C.-PC-temperature enthalpy, 30 wt. % fiber balls of CoPES binder fiber and 35 wt. % down and/or fine feathers and feathers from the Minardi company are placed on a support belt in an air-laid plant of the Form Fiber company, having spiked rolls for the opening of the fiber raw material, and consolidated in a double belt oven with a belt spacing of 10 mm at 155° C. The dwell time was 36 seconds. A rollable web material was obtained.

Example 3

150 g/m$^2$ of 50 wt. % fiber balls of wool and 50 wt. % fiber balls of CoPES binder fiber are placed on a support belt in an air-laid plant of the Form Fiber company, having spiked rolls for the opening of the fiber raw material, and consolidated in a double belt oven with a belt spacing of 12 mm at 155° C. The dwell time was 36 seconds. A rollable web material was obtained.

Example 4

150 g/m$^2$ of 50 wt. % fiber balls of silk and 50 wt. % fiber balls of CoPES binder fiber are placed on a support belt in an air-laid plant of the Form Fiber company, having spiked rolls for the opening of the fiber raw material, and consolidated in a double belt oven with a belt spacing of 12 mm at 155° C. The dwell time was 36 seconds. A rollable web material was obtained.

Example 5

56 g/m$^2$ of 80 wt. % fiber balls and 20 wt. % of CoPES binder fiber are placed on a support belt in an air-laid plant of the Form Fiber company, having spiked rolls for the opening of the fiber raw material, and consolidated in a double belt oven with a belt spacing of 1 mm at 170° C. A rollable web material was obtained with a thickness of 6.1 mm.

Example 6

128 g/m$^2$ of 80 wt. % fiber balls and 20 wt. % of CoPES binder fiber are placed on a support belt in an air-laid plant of the Form Fiber company, having spiked rolls for the opening of the fiber raw material, and consolidated in a double belt oven with a belt spacing of 4 mm at 170° C. A rollable web material was obtained with a thickness of 7.5 mm.

Example 7

128 g/m$^2$ of 80 wt. % fiber balls and 20 wt. % of CoPES binder fiber are placed on a support belt in an air-laid plant of the Form Fiber company, having spiked rolls for the opening of the fiber raw material, and consolidated in a double belt oven with a belt spacing of 30 mm, i.e., without loading of the fiber sheet, at 170° C. A soft, rollable web material was obtained with a thickness of 25 mm.

Example 8

723 g/m$^2$ of 80 wt. % fiber balls and 20 wt. % of CoPES binder fiber are placed on a support belt in an air-laid plant of the Form Fiber company, having spiked rolls for the opening of the fiber raw material, and consolidated in a double belt oven with a belt spacing of 50 mm at 170° C. A rollable stable web material was obtained with a thickness of 50 mm.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A nonwoven fabric, comprising:

a volume-giving material which comprises fiber balls opened by means of spiked rolls or spiked belts, wherein the nonwoven fabric is homogeneous and the volume-giving material is uniformly distributed therein, the volume-giving material comprises mutually interlocking fiber balls, the nonwoven fabric is not needled, and the nonwoven fabric has a maximum tensile strength, measured according to DIN EN 29 073, at a mass per unit area of 50 g/m$^2$, in at least one direction of at least 0.3 N/5 cm.

2. The fabric of claim 1, wherein the volume-giving material comprises fiber balls comprising polyester fibers.

3. The fabric of claim 1, wherein the volume-giving material comprises fiber balls comprising wool.

4. The fabric of claim 1, wherein the volume-giving material comprises fiber balls comprising binder fibers having a length of 0.5 mm to 100 mm.

5. The fabric of claim 4, wherein the binder fibers are configured as core/shell fibers, wherein the shell comprises polybutylene terephthalate (PBT), polyamide (PA), a copolyamide, a copolyester, or two or more of any of these, and/or wherein the core comprises polyethylene terephthalate (PET), polyethylene naphthalate (PEN), polyolefin (PO), polyphenylene sulfide (PPS), aromatic polyamide (PA), and/or polyether sulfone (PES).

6. The fabric of claim 4, wherein the binder fibers in the nonwoven fabric are present in a range of 5 to 50 wt. % relative to a total weight of the nonwoven fabric.

7. The fabric of claim 4, further comprising:

a phase change material.

8. The fabric of claim 1, wherein the maximum tensile strength, measured according to DIN EN 29 073, at a mass per unit area of 50 g/m$^2$, in at least one direction of 0.3 N/5 cm to 100 N/5 cm.

9. The fabric of claim 1, wherein the volume-giving material comprises fiber balls in an amount of at least 20 wt. %, relative to a total weight of the nonwoven fabric.

10. The fabric of claim 1, wherein the volume-giving material comprises fiber balls in an amount of at least 25 wt. %, relative to a total weight of the nonwoven fabric.

11. The fabric of claim 1, wherein the volume-giving material comprises fiber balls in an amount of 30 to 90 wt. %, relative to a total weight of the nonwoven fabric.

12. The fabric of claim 1, wherein the volume-giving material further comprises down and/or fine feathers in an amount of 20 to 70 wt. %, relative to a total weight of the nonwoven fabric.

13. The fabric of claim 1, wherein the volume-giving material comprises fiber balls comprising polyethylene terephthalate, polyethylene naphthalate, polybutylene terephthalate, or two or more of any of these.

14. The fabric of claim 4, wherein the binder fibers in the nonwoven fabric are present in a range of 7 to 40 wt. %, relative to a total weight of the nonwoven fabric.

15. The fabric of claim 4, wherein the binder fibers in the nonwoven fabric are present in a range of 10 to 35 wt. %, relative to a total weight of the nonwoven fabric.

16. The fabric of claim 9, wherein the volume-giving material further comprises down and/or fine feathers in an amount of 20 to 70 wt. %, relative to a total weight of the nonwoven fabric.

17. The fabric of claim 1, wherein the fiber balls are opened in random directions.

* * * * *